United States Patent [19]

Piber

[11] 4,149,052

[45] Apr. 10, 1979

[54] SAFETY-DISCONNECT POWER TOOL SWITCH

[75] Inventor: Earl T. Piber, Oconomowoc, Wis.

[73] Assignee: Cutler-Hammer, Inc., Milwaukee, Wis.

[21] Appl. No.: 891,898

[22] Filed: Mar. 30, 1978

[51] Int. Cl.[2] ..... H01H 1/16; H01H 3/32; H01H 9/02

[52] U.S. Cl. ..... 200/153 LA; 200/67 R; 200/302; 179/18 GC

[58] Field of Search ..... 200/61, 67 R, 243, 16 A, 200/153 LA, 159 R, 302; 74/511 R; 179/18 GC

[56] References Cited

U.S. PATENT DOCUMENTS

| | | | |
|---|---|---|---|
| 1,589,922 | 6/1926 | Anderson | 200/61 |
| 3,035,134 | 5/1962 | Hults | 200/67 R |
| 3,047,682 | 7/1962 | Hults | 200/153 LA |
| 3,953,697 | 4/1976 | Teichert | 200/243 |

*Primary Examiner*—George T. Hall

[57] ABSTRACT

An electric power tool mounted switch that provides safety-disconnect under contact-weld conditions, and is of the manual close, manual open, or momentary (spring return), double-pole type having an actuator of the toggle lever, trigger or other suitable type. The operating member actuates one end of an intermediate lever normally pivoted at its other end on a slidable safety-disconnect bar that is normally held to the base by a first spring-loaded detent. The intermediate lever is coupled and pivotally mounted at its midportion to a slidable contact carrier through a firing spring and positive action mechanism. The contact carrier slides along and is held to the safety-disconnect bar by a second spring-loaded detent in either its contacts closed or contacts open position. In normal operation, upon movement of the actuator to "on", one firing spring is compressed and follow-up positive action causes the second detent to release allowing the contact carrier to snap over and close the contacts, and similarly to reopen the contacts under manual control or momentary return spring force and the other firing spring and follow-up positive action. Should one or more contacts weld closed so that the contact carrier cannot return, the intermediate lever compresses the other firing spring whereupon follow-up positive action releases the first detent allowing the safety-disconnect bar to trip and snap over and force out a component such as a kick-out spring on a stationary contact that causes the circuit to open. This helical, compressed, kick-out spring normally holds a close-first open-last leaf spring stationary contact against one movable contact but when kicked out, allows the stationary contact to flex open under its inherent bias thereby to interrupt the power circuit to the tool.

13 Claims, 6 Drawing Figures

Fig. 4
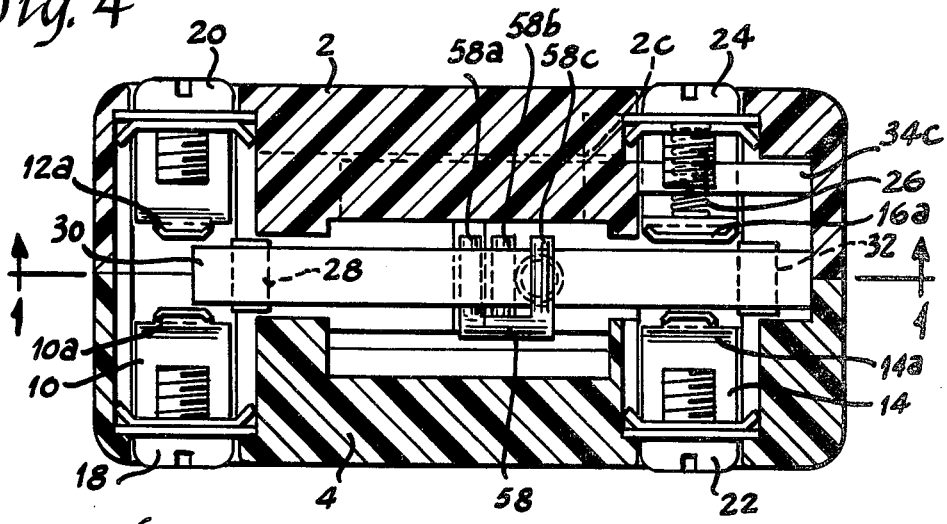
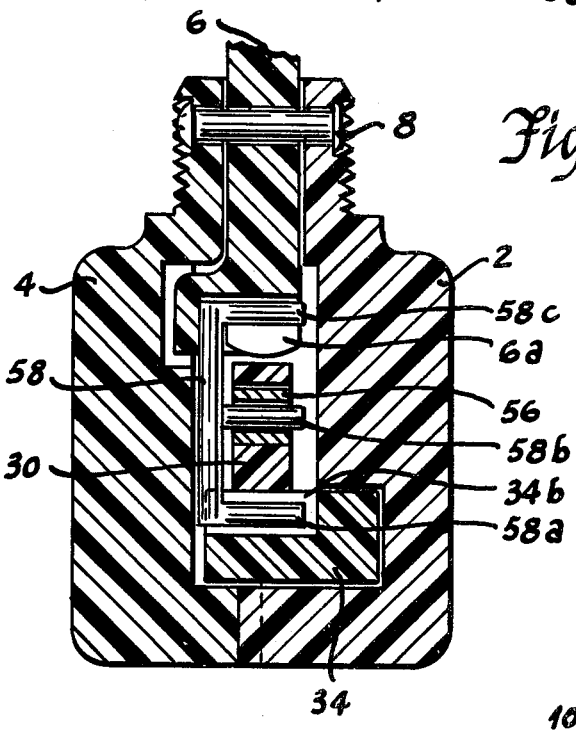
Fig. 5
Fig. 6
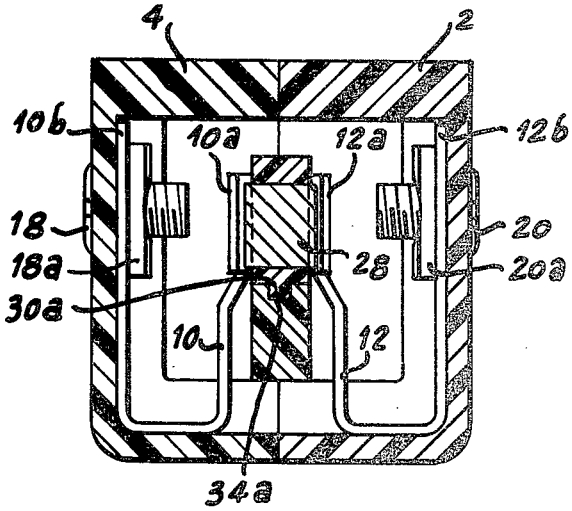

SAFETY-DISCONNECT POWER TOOL SWITCH

BACKGROUND OF THE INVENTION

Switches have been known heretofore that have included features affording opening thereof under contact sticking or welding conditions. For example, positive action switches such as shown in H. W. Hults U.S. Pat. No. 3,035,134, dated May 15, 1962, have been provided with an operating mechanism that positively and unyieldingly transmits force to the movable contacts to provide shear for breaking any weld. E. L. Long copending Application Ser. No. 735,691, filed Oct. 26, 1976, and assigned to the assignee of this application, shows a safety disconnect switch that opens a series connection in the event the switch contacts weld. While these prior switches have been useful for their intended purpose, this invention relates to a safety-disconnect switch that does not rely on forcibly opening welded contacts but instead opens a separate close-first open-last contact that normally does not weld.

SUMMARY OF THE INVENTION

An object of the invention is to provide an improved safety-disconnect switch.

A more specific object of the invention is to provide a safety-disconnect switch that incorporates integral means for interrupting the electrical connection for weld-protection purposes.

Another specific object of the invention is to provide a safety-disconnect switch that includes, in circuit with the switch contacts, a separable close-first open-last contact for actuation despite contact-weld conditions.

Another specific object of the invention is to provide a switch of the manual close type with safety-disconnect means for automatically tripping open another separable contact in response to opening movement of the switch actuator under contact-weld conditions and for preventing reclosure thereof by further manipulation of the switch actuator.

Another specific object of the invention is to provide a safety-disconnect switch of the aforementioned type incorporating means for snap-action opening of said another separable contact and for maintaining the same open thereafter.

Other objects and advantages of the invention will hereinafter appear.

BRIEF DESCRIPTION OF THE DRAWINGS

FIG. 4 is a horizontal cross-sectional view taken along line 4—4 of FIG. 1 showing the contacts and intermediate lever in top view;

FIG. 5 is a lateral cross-sectional view taken along line 5—5 of FIG. 1 to show the intermediate lever; and FIG. 6 is a lateral cross-sectional view taken along line 6—6 of FIG. 1 to show one of the movable contacts mounted in the contact carrier and the associated stationary contacts.

DESCRIPTION OF THE PREFERRED EMBODIMENT

Referring to FIGS. 1-6, there is shown a weld-protected safety-disconnect industrial tool handle switch constructed in accordance with the invention. As shown therein, the switch is provided with a split, insulating housing including a base half 2 and a cover half 4 connected together to provide a switch compartment therewithin. This switch compartment consists of suitable recesses in the base and cover to receive and retain the parts of the switch mechanism and allow required movement thereof.

These switch mechanism parts include a manual actuator in the form of a toggle over 6 pivotally supported by a pivot pin 8 in the bore of a bushing formed from contiguous semicylindrical portions 2*a* and 4*a* at the top of the base and cover, respectively. This bushing is provided with an external thread so that the bushing can be inserted through a hole in a panel and a nut turned thereon to mount the switch to the panel. The upper end of this toggle lever extends out from the bushing for manual, pivotal actuation by the user while the lower end thereof extends into the housing compartment for operation of the switch as hereinafter described.

Figure 1:
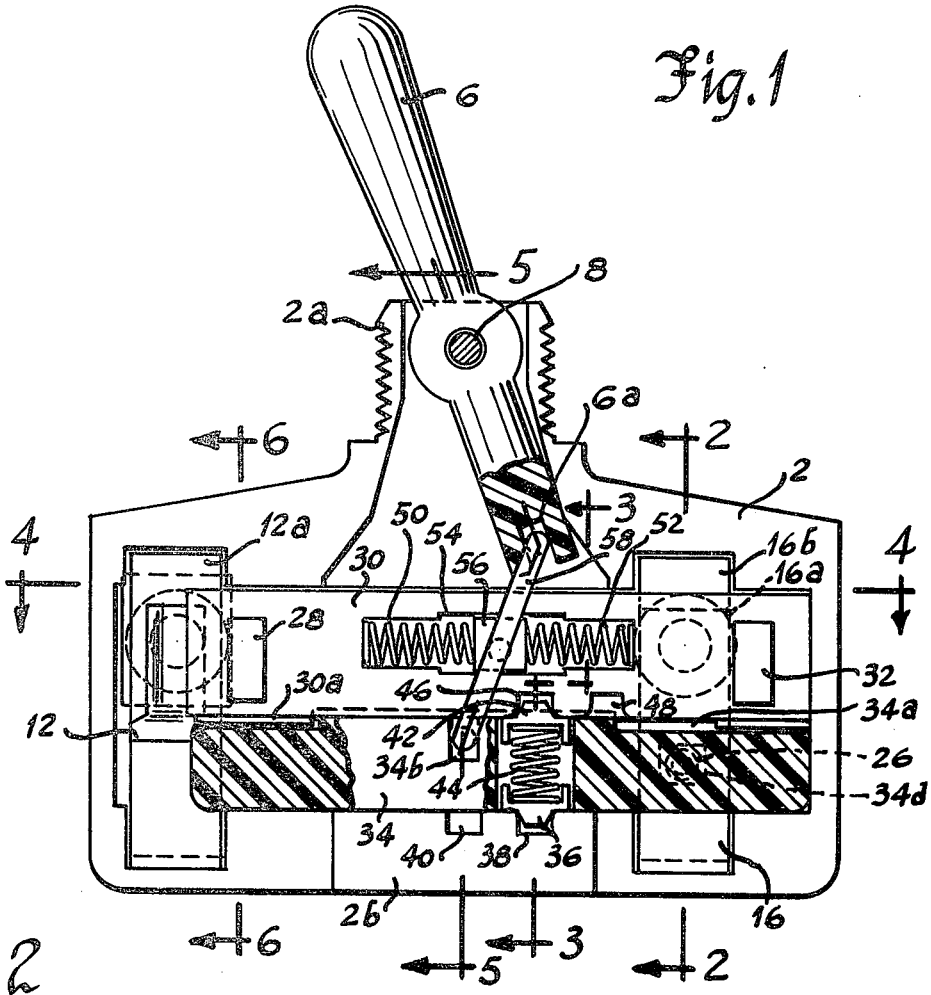
FIG. 1 is an enlarged, longitudinal, vertical cross-sectional view of a toggle lever operated safety-disconnect switch taken along line 1—1 of FIG. 4 showing the internal mechanism thereof.
Figure 2:
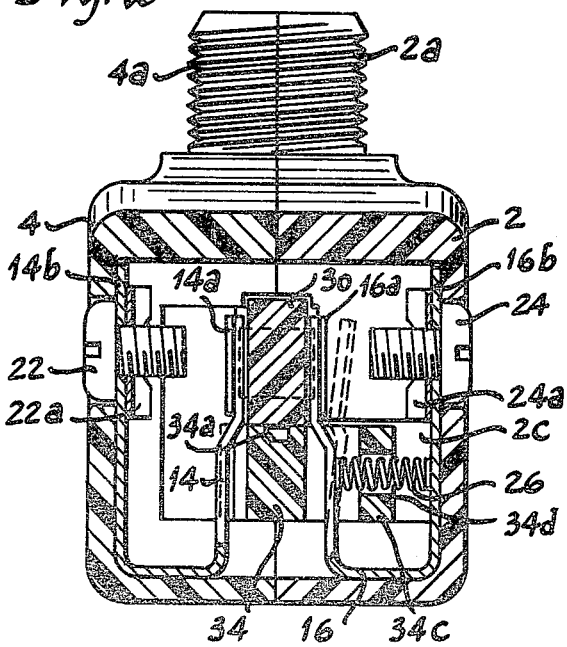
FIG. 2 is a lateral cross-sectional view taken along line 2—2 of FIG. 1 showing a safety-disconnect contact and the associated kick-out spring.

These switch mechanism parts also comprise two pairs of stationary contacts including contacts 10 and 12 of the left-hand pair and contacts 14 and 16 of the right-hand pair as shown in FIG. 4, and also in FIGS. 1, 2 and 6. The contacting portion 16*a* of the contact 16 of the right-hand pair may be made wider than the other ones as shown in FIG. 4 so that this stationary contact 16 closes first and opens last with the associated movable contact in order to avoid any arcing, degradation and welding at safety disconnect contact 16 and thus insure opening thereof when needed as hereinafter more fully described. Each stationary contact 10, 12, 14 and 16 is generally U-shaped as shown in FIGS. 2 and 6 with its contacting portion 10*a*, 12*a*, 14*a* and 16*a* being at the upper end of the inner arm and the terminal portion 10*b*, 12*b*, 14*b* and 16*b* thereof being at the upper end of the outer arm. The contacting portion of each stationary contact is offset inwardly a small amount as shown in FIGS. 2 and 6 to insure good electrical engagement with the associated movable bridging contact. The terminal portions of the stationary contacts are provided with one screw hole each, through which respective terminal screws 18, 20, 22 and 24 extend, and the latter are threaded into respective nuts 18*a*, 20*a*, 22*a* and 24*a*, for connecting the switch to an external circuit. These nuts are preferably made of thin metal or the like and opposite lateral edges are bent at small angles inwardly as shown in FIG. 4, so that, as each stationary contact is pressed into place in its slot, the corners of these bent edges bite into the opposite walls of its slot with an interference fit. For this purpose, the base and cover are made of molded plastic material or the like so that the corners of the metal nuts will bite thereinto. This retains each stationary contact terminal portion against the adjacent wall of the housing and prevents stationary contact 16 in FIG. 2 from tipping inwardly after safety disconnect spring 26 has been bumped out as hereinafter described.

The adjacent arms of stationary contact pair 10 and 12 are provided with a self-bias tending to move them toward one another and against the contact carrier as shown in FIG. 6 so that contacting portions 10a and 12a will make a good pressure contact with bridging contact 28 when it is slid therebetween. In a similar manner, the contactor arm of stationary contact 14 is provided with a self-bias tending to move it toward and with pressure against contact carrier 30 as shown in FIG. 2 so that contacting portion 14a thereof will make a good electrical contact with bridging contact 32 when the latter is slid into registration with it. On the other hand, safety disconnect stationary contact 16 is provided with an opposite self-bias tending to move it away from bridging contact 32 as shown by broken lines in FIG. 2 so that contacting portion 16a thereof will separate from movable bridging contact 32 when kick-out spring 26 is pushed out from between the arms of stationary contact 16. As will be apparent, helical compression spring 26 normally provides a bias to press contacting portion 16a against contact carrier 30 as shown in FIG. 2 so that it will be engaged by movable bridging contact 32 when the latter is slid between contacts 14 and 16 to bridge the same.

Figure 3:
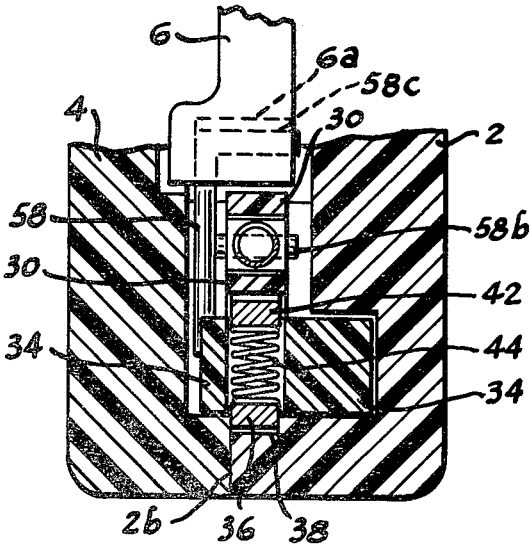
FIG. 3 is a lateral cross-sectional view taken along line 3—3 of FIG. 1 showing the spring-biased detent mechanism of the safety disconnect bar and one of the firing springs.

The aforementioned switch mechanism parts also include a safety disconnect bar 34 and contact carrier 30 with the lower surface of the contact carrier resting on the upper surface of bar 34, the latter resting on the bottom of the housing and being leftwardly slidable thereon but held in place by a spring-loaded detent 36 as shown in FIG. 1. The contact carrier and safety disconnect bar are provided with partial tongue and groove couplings 30a and 34a at their end portions as shown in FIGS. 1, 2 and 6 to allow leftward movement of the contact carrier with respect to the safety-disconnect bar from the relative position shown in FIG. 1. This keeps them in alignment with one another while permitting the contact carrier to be moved leftward relative to the safety disconnect bar to close the contacts. The bottom of the base is provided with a first notch 38 into which spring-biased detent 36 extends as shown in FIGS. 1 and 3 to hold the safety disconnect bar in its rightward normal position, and a second notch 40 into which detent 36 may be snapped when the safety disconnect bar is moved to its leftward safety-disconnect position under contact-weld conditions as hereinafter more fully described. Base 2 is provided with an extension 2b as shown in FIGS. 1 and 3 fitting into a slot in the cover to provide for slots 36 and 40.

A second spring-biased detent 42 retains the contact carrier with respect to the safety disconnect bar. Detents 36 and 42 may utilize a single loading spring 44 by providing a vertical hole through safety disconnect bar 34 with detent 36 projecting from the lower end of this hole and detent 42 projecting from the upper end of this hole and helical spring 44 in compression therebetween as shown in FIGS. 1 and 3. Contact carrier 30 is provided on its lower surface with a first notch 46 into which detent 42 extends to hold the contacts open, and a second notch 48 into which detent 42 may be snapped when the contacts are closed.

Movable bridging contacts 28 and 32 may be rectangular blocks held in transverse holes in the contact carrier as shown in FIG. 1 and extending slightly out from the opposite sides of the contact carrier as shown in FIGS. 2 and 6 for good pressure engagement with the pairs of stationary contacts.

The contact carrier is also provided with a snap-action positive-action mechanism having a pair of helical, compression, firing springs including a left spring 50 for snap-action closing of the contacts and a right spring 52 for snap-action opening of the contacts. The springs are retained in partial compression between the left and right ends of an elongated horizontal slot 54 at the longitudinal center of the contact carrier and the left and right sides, respectively, of a positive-action, spring block 56. Slot 54 is wider at its center portion to accommodate spring block 56 than it is at its end portions that accommodate the two springs. The shoulders at the left and right ends of this wider portion provide stops for the spring block after a given firing spring has been compressed enough for snap-action thereby to provide positive, unyielding force from the actuator to release the contact carrier from its detent, following which the compressed firing spring snaps the contact carrier to its other position.

The aforementioned switch mechanism parts also include a generally E-shaped intermediate lever 58 shown in FIGS. 1, 3, 4 and 5. This intermediate lever is pivotally coupled at its lower end on the safety disconnect bar, is driven at its upper end by the toggle lever actuator and is supported by and coupled at its intermediate portion through spring block 56 to the contact carrier to drive the latter. For this purpose, intermediate lever 58 is provided at its lower end with an integral, cylindrical lateral pin 58a extending from one side into a vertical-sided slot 34b is safety-disconnect bar 34 as shown in FIGS. 1 and 5. The arrangement is such that pin 58a can move down or up in slot 34b as shown in FIG. 5 when the intermediate lever rotates on spring block 56 through the limited angles necessary for operation of the switch.

Also for this purpose, intermediate lever 58 is provided at an intermediate point therealong with a lateral journal 58b whereby it is pivotally supported in a lateral hole in spring block 56 for rotary movement on the latter. And the upper end of lever 58 is provided with a cylindrical, lateral pin 58c extending partway into a vertical-sided slot 6a extending upwardly from the lower end of the toggle lever. The arrangement is such that pin 58c can move up or down in slot 6a when the toggle lever is actuated through the limited angles necessary for operation of the switch.

Safety-disconnect bar 34 is provided with means for dislodging spring 26 from between the arms of stationary contact 16 in the event one or more of the other three contacts welds. For this purpose, bar 34 is provided with a laterally offset parallel leg 34c at its right-hand in FIG. 4 as shown more clearly in FIG. 2. This leg 34 has a lateral, square hole 34d therethrough as shown in phantom in FIG. 1 through which kick-out spring 26 extends. Consequently, if the safety-disconnect bar is moved leftward in FIGS. 1 and 4, the right side of hole 34d will engage the center of spring 26 and push it out from between arms 16a and 16b of stationary contact 16, thus allowing the self-bias in arm 16a to break the contact.

While a toggle lever 6 has been shown as the switch actuator for exemplary purposes, it will be apparent that other forms of actuators can be used. For example, a horizontally slidable trigger or slide button could be used in place of the toggle lever if the upper portion of the housing were redesigned to accommodate the same. Such trigger or slide button would have a vertical-sided slot similar to slot 6a to engage the upper end of the intermediate lever. Such trigger would normally be of the manual close, return spring open type known as momentary type while a slide button actuator normally would be manually operated to both close and open the switch.

The operation of the switch is as follows. Movement of the toggle lever clockwise causes the intermediate lever to swing left pivoting at its lower end. Its journal 58b moves spring block 56 leftward compressing firing spring 50 until block 56 abuts the shoulders in the left-hand portion of the spring slot. Further movement of the toggle lever applies positive force to the contact carrier to release it from detent 42 and allow firing spring 50 to snap it leftward to contacts-closed position wherein detent 42 enters slot 48.

Referring to FIG. 4, it will be seen that because the contacting portion 16a of stationary contact 16 is wider than the other ones, movable bridging contact 32 will engage it first thereby preventing any arcing heating and avoiding any welding at this contact. Thereafter, movable contact 32 slides on stationary contacting portion 16a at one end and at its other end engages stationary contacting portion 14a. At the same time, movable bridging contact 28 engages stationary contacting portions 10a and 12a to complete the circuit which, for example, may have these two sets of bridging contacts connected as two poles of a double-pole switch in the respective power lines between a power source and a load device such as a portable electric tool motor. With this contact structure, contacts 16a and 32 will be assured of being always non-welded and free to open in the event one of the other three contacts welds.

In the event one of those other three contacts welds and does not open when the toggle lever is moved back counterclockwise, intermediate lever 58 will pivot on its lower pin 58a only enough to compress spring 52 until block 56 abuts the stop shoulders at the right-hand portion of slot 54. Positive action thereafter transmits leftward force on safety-disconnect bar 34 to release detents 36 and 42 from slots 38 and 48, respectively, thus allowing firing spring 52 to trip safety-disconnect bar 34 leftward so that detents 36 and 42 enter slots 40 and 46. During this snap-action motion of bar 34, leg 34c thereof snaps kick-out spring 26 leftward out from between arms 16a and 16b of stationary contact 16 to allow arm 16a to trip open from movable contact 32 thereby to insure interruption of the circuit despite the failure of the other three contacts to open. Base 2 is provided with sufficient clearance space 2c shown in FIGS. 2 and 4 to receive spring 26 free of stationary contact 16 under such conditions. While only one contact has been arranged for safety-disconnect in the exemplary embodiment, it will be apparent that another contact could be so constructed and provided with a kick-out spring to be assured of two interruptions in the event one or both of the remaining two contacts welds. For example, the safety-disconnect bar could be provided with an offset leg at its left end to eject a kick-out spring from contact 12.

While the apparatus hereinbefore described is effectively adapted to fullfill the objects stated, it is to be understood that the invention is not intended to be confined to the particular preferred embodiment of safety-disconnect power tool switch disclosed, inasmuch as it is susceptible of various modifications without departing from the scope of the appended claims.

I claim:

1. A safety-disconnect switch comprising:

an insulating housing;

and means in said housing providing a controllable electrical connection under normal conditions and effecting a safety-disconnect under contact-weld conditions comprising:

a plurality of stationary contacts in said housing;

a plurality of movable contacts in said housing arranged to close and open with respect to said stationary contacts to complete and interrupt said electrical connection;

switch operating means for said movable contacts for closing and opening the same;

safety-disconnect means associated with at least one set of said movable and stationary contacts and normally operable to allow the associated movable contact to engage the stationary contact when said switch operating means is actuated to close said contacts;

means preventing conditions that could cause welding between said one stationary contact and its associated movable contact;

and means comprising tripping means normally restrained but movable in response to actuation of said switch operating means in attempted opening of said movable contacts under welded contact conditions to actuate said safety-disconnect means and afford separation of at least said one of said stationary and movable contacts.

2. The safety-disconnect switch claimed in claim 1, wherein:

said means preventing welding conditions between said one stationary contact and its associated movable contact comprises means providing the same with a close-first open-last structural arrangement with respect to the other contacts so that arcing heating thereat is avoided.

3. The safety-disconnect switch claimed in claim 1, wherein said switch operating means comprises:

a detented, reciprocable contact carrier carrying said movable contacts in said housing:

a manual actuator mounted on said housing;

an intermediate lever and means providing a pivot for one end thereof within said housing, said lever being driven at its other end by said manual actuator;

and means coupling an intermediate portion of said lever to said contact carrier to reciprocate the latter when said actuator is moved in one direction and back.

4. The safety-disconnect switch claimed in claim 3, wherein:

said safety-disconnect means comprises a resilient element normally maintaining said one stationary contact in a position to be engaged by its associated movable contact when said switch operating means is actuated to close the contacts;

and said tripping means comprises a movable but detented safety-disconnect tripping member including said means providing a pivot for one end of said intermediate lever and being releasable from its detent and movable by said intermediate lever, and also including means for tripping said resilient member;

and said safety-disconnect means also comprises means responsive to said tripping of said resilient member for effecting separation of said one stationary contact from its associated movable contact.

5. The safety-disconnect switch claimed in claim 4, wherein:

said resilient element is a compression spring normally applying a force to said one stationary contact;

and said means for tripping said resilient element comprises a portion of said safety-disconnect tripping member having a hole through which said spring passes whereby tripping of said member under contact weld conditions snaps said spring away from said one stationary contact to effect said separation of the latter from its associated movable contact.

6. The safety-disconnect switch claimed in claim 5, wherein:

said means responsive to said tripping of said resilient member for effecting separation of said one stationary contact from its associated movable contact comprises a self-bias in said one stationary contact caused by being normally stressed by said compression spring into engagement with its associated movable contact.

7. The safety-disconnect switch claimed in claim 6, wherein:

said self-bias causes said one stationary contact, in effecting said separation from its associated movable contact, to move into the space previously occupied by said spring so that said spring cannot be re-introduced thereinto by manipulation of said switch operating means.

8. The safety-disconnect switch claimed in claim 3, wherein:

said safety-disconnect tripping member is detented to said housing;

and said contact carrier is detented to said safety-disconnect tripping member.

9. The safety-disconnect switch claimed in claim 8, wherein:

said contact carrier is arranged for reciprocable sliding movement along said safety-disconnect tripping member and their adjacent surfaces are provided with means maintaining them in alignment with one another.

10. The safety-disconnect switch claimed in claim 9, wherein:

said means maintaining said contact carrier and said safety-disconnect tripping member in alignment with one another comprises tongue and groove coupling therebetween.

11. A power tool switch having an integral safety-disconnect feature comprising:

an insulating housing;

and means in said housing providing a selectively controllable electrical connection under normal conditions and effecting a safety-interruption of said connection despite contact-weld conditions comprising:

a plurality of pairs of stationary contacts mounted in said housing;

a plurality of movable bridging contacts in said housing arranged to close and open with respective pairs of said stationary contacts to complete and interrupt said electrical connection;

movable-contact operating means manually controllable to close and open said movable bridging contacts with respect to said pairs of stationary contacts;

safety-disconnect means normally biasing one of said stationary contacts into a position for engagement by the associated movable contact when said operating means is actuated to close the contacts;

said one stationary contact and its associated movable contact being constructed and arranged for close-first open-last operation relative to the other contacts thereby to prevent arcing and consequent welding thereat to insure that this contact will open even if one or more of the other contacts welds;

and a safety-disconnect tripping bar normally detent restrained but being releasable in response to attempted opening actuation of said operating means in the event one or more of the other contacts is welded to effect snap-action movement of said safety-disconnect means to relieve the bias from said one stationary contact and allow it to separate from its associated movable contact thereby to interrupt said electrical connection.

12. The power tool switch having an integral safety-disconnect feature claimed in claim 11, wherein:

said safety-disconnect means comprises a helical compression spring positioned to impose said bias on said one stationary contact so as to stress the same into said position for engagement by its associated movable contact.

13. The power tool switch having an integral safety-disconnect feature claimed in claim 12, wherein:

said one stationary contact comprises a generally U-shaped member having a terminal arm and a contacting arm between which said helical spring is normally compressed to bias said contacting arm into position for engagement by its associated movable contact while said terminal arm is mounted in said housing.

* * * * *